US005934378A

United States Patent [19]

Tchakarov

[11] Patent Number: 5,934,378

[45] Date of Patent: Aug. 10, 1999

[54] CENTRALIZERS FOR A DOWNHOLE TOOL

[75] Inventor: Borislav J. Tchakarov, Houston, Tex.

[73] Assignee: Computalog Limited, Calgary, Canada

[21] Appl. No.: 08/908,402

[22] Filed: Aug. 7, 1997

[51] Int. Cl.[6] ..... E21B 17/10

[52] U.S. Cl. ..... 166/381; 166/241.6; 175/325.5

[58] Field of Search ..... 175/230, 325.1, 175/325.5; 166/381, 241.5, 241.6

[56] References Cited

U.S. PATENT DOCUMENTS

| | | | |
|---|---|---|---|
| 3,555,689 | 1/1971 | Cubberly, Jr. | 166/241.5 |
| 4,681,160 | 7/1987 | Fineberg | 175/325.4 |
| 4,776,397 | 10/1988 | Akkerman | 166/241.5 |
| 5,348,091 | 9/1994 | Tchakarov et al. | 166/241.6 |
| 5,678,630 | 10/1997 | Shaw et al. | 166/241.4 |

*Primary Examiner*—William Neuder
*Attorney, Agent, or Firm*—James E. Bradley; Andrew J. Dillon

[57] ABSTRACT

A measurement while drilling tool has upper and lower centralizers secured to an upper end. Each centralizer comprises three major components: a housing, a tapered nose, a shaft which is slides in a bore of the housing, and a set of fingers around the shaft. The nose of the lower centralizer is tapered at a greater angle than the nose of the upper centralizer. An upper end of each finger is pivotally attached to the shaft. The fingers slidingly engage the nose when they are not in a retracted position. The centralizers are suspended in a drill pipe so that the shafts are fully extended from their housings. With the shafts extended, the fingers retract. Prior to drilling, the tool is lowered until it lands in a sub which causes the lower shaft to slides downward into the housing. The lower fingers move outward to engage the drill pipe without wedging against it. The upper shaft then slides downward into its housing, causing its fingers to move to an extended position and frictionally wedge between the upper nose and the pipe. The tool may be retrieved by running the line back down to the tool to jar the upper fingers loose from the pipe. Once the upper fingers disengage, the upper shaft slides upward out of its housing to allow the lower shaft to move upward. The lower fingers then fall into the retracted position before the tool is lifted out of the pipe.

11 Claims, 3 Drawing Sheets

CENTRALIZERS FOR A DOWNHOLE TOOL

TECHNICAL FIELD

This invention relates in general to downhole tools and in particular to a centralizing device for measurement while drilling tools,

BACKGROUND ART

Measurement while drilling (MWD) allows for the surface acquisition of downhole data during drilling, thereby reducing the need for costly and time consuming drill string tripping and logging/survey runs otherwise necessary to acquire downhole data.

MWD systems typically include the placement of a complex and expensive self-contained package of sensors, power supplies and transmitters very near the drill bit. While this position is desirable, it presents a harsh, hot, highly pressured, dirty and high shock load environment for the MW) tool. MWD tool failures are not uncommon, requiring retrieval and replacement of the tool downhole. In the event the drill pipe becomes stuck in the hole, the MWD tool may be permanently lost. As downhole vibrations act on retrievable MWD tools, the modules of the tool have a tendency to rattle or bang against the internal walls of the surrounding MWD receptacle thereby amplifying the vibrations. Thus, to reduce the potential damage caused by these downhole shocks, it is desirable to centralize and secure the retrievable MWD systems within their surrounding MWD receptacles.

One common method of improving the centralization of MWD tools involves the use of donut-shaped rubber rings. These rubber rings are placed around the circumference of MWD tools to increase their outer diameter and cushion some of the shock effects described above. However, the rings must be sized to pass through the smallest drill string restriction; otherwise, a tool could not pass through the restriction. This sizing limitation results in a less than tight fit between the tool and the surrounding receptacle, which hinders the effectiveness of the rings.

Another device for centralizing MWD tools is described in U.S. Pat. No. 5,348,091. That device utilizes a single upper centralizer having a housing which is attached to a MWD tool while at the surface. The combined apparatus is lowered through the drill string by wireline releasably attached to a sliding shaft. During lowering, the weight of the housing and tool extends the slidable shaft, positioning extendable fingers above a tapering nose on the housing in a retracted position. When the tool lodges downhole, the slidable shaft moves downward, causing the fingers to move outward against the drill pipe. During drilling operations, mud flowing through the drill pipe acts downwardly on a flared portion of the slidable shaft, thereby inducing more forcible extension of the fingers against the drill pipe and maintaining centralization of the tool. Retrieval of the tool is typically made by interrupting mud flow and lifting the centralizer through the drill string by wireline. Although this device has been more successful than the rubber rings, an improved middle centralizer is desirable for fairly long tools including tools other than MWD that are lowered through conduit and retrieved on wireline.

DISCLOSURE OF INVENTION

A measurement while drilling tool has upper and lower centralizers. Each centralizer comprises three major components: a housing having a lower portion and an upper portion with a tapered nose, a shaft with a piston on a lower end which is slidably disposed in an axial bore created by the upper and lower housing portions, and a carrier with a set of fingers which are disposed around the shaft. The tapered nose of the lower centralizer is tapered at a greater angle than the tapered nose of the upper centralizer. An upper end of each finger is pivotally attached to the carrier. The fingers slidingly engage the nose when they are not in a retracted position. The lower centralizer is connected to an upper part of the tool and its lower housing is connected to the lower part of the tool. Only the lower housing of the upper centralizer is connected to the tool.

The centralizers are suspended in a drill pipe so that the shafts are fully extended from their housings. With the shafts extended, the fingers retract. Prior to drilling, the tool is lowered until it lands in a sub which causes the lower shaft to slides downward into the housing. The lower fingers move outward to engage the drill pipe without wedging against it. The upper shaft then slides downward into its housing, causing its fingers to move to an extended position and frictionally wedge between the upper nose and the pipe.

The tool may be retrieved by running the line back down to the tool to jar the upper fingers loose from the pipe. Once the upper fingers disengage, the upper shaft slides upward out of its housing to allow the lower shaft to move upward. The lower fingers then fall into the retracted position before the tool is lifted out of the pipe.

BEST MODE FOR CARRYING OUT THE INVENTION

Figure 1:
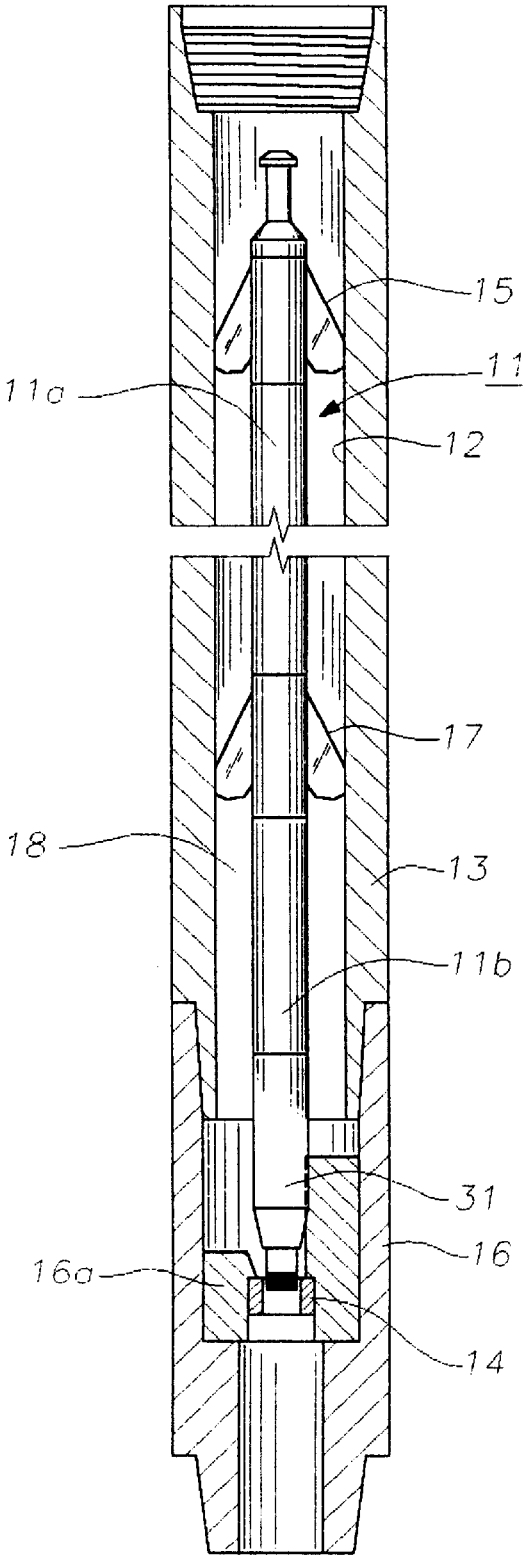
FIG. 1 is a schematic sectional side view of a pulse system in a drill pipe.

Referring to FIG. 1, a measurement while drilling (MWD) tool 11 is shown suspended in the bore 12 of a string of drill pipe 13 and a sub 16. The lower end of tool 11 is supported on a shoulder 14 in a guidance system 16*a* of sub 16. Tool 11 contains a set of instruments 11*a* and a pulser 11*b*. Tool 11 also has an upper centralizer 15 and a lower centralizer 17. Lower centralizer 17 is connected to a middle portion of tool 11 while upper centralizer 15 is connected to an upper portion of tool 11 above lower centralizer 17. Centralizers 15, 17 are in contact with bore 12 and are self-adjusting.

Figure 2:
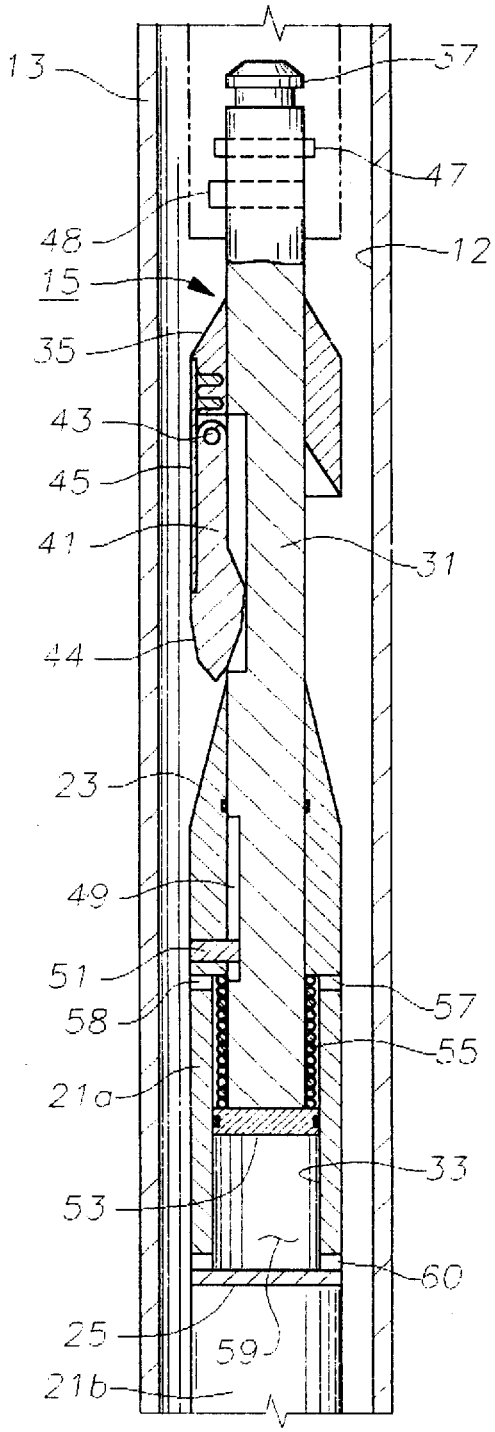
FIG. 2 is a partial sectional side view of an upper centralizer with retracted fingers and is constructed in accordance with the invention.

As shown in FIG. 2, upper centralizer 15 comprises three major components. The first is a housing 21 having upper and lower portions 21*a*, 21*b*, a tapered nose 23 and a bolting plate 25 for attachment to tool 11. Housing 21 is a tubular member which may also contain electrical components of tool 11. Nose 23 is tapered in the range of eight to twelve degrees, preferably ten degrees, relative to the axis of bore 12. Many types of connectors may be substituted for bolting plate 25.

The second major component is shaft 31, which is slidably disposed in an axial bore 33 in housing 21. The upper end of shaft 31 includes a carrier or flared portion 35 and a neck 37 for releasable attachment to wireline or coiled tubing. A piston 53 is secured to the lower end of shaft 31. Piston 53 slidingly engages bore 33 in housing lower portion 21*b*. An optional compression spring 55 extends through an annulus surrounding the lower end of shaft 31 between piston 53 and a lower shoulder 57 on nose 23. Spring 55 urges shaft 31 downward relative to housing 21. A clearance 59 exists between piston 53 and plate 25 to allow shaft 31 to move axially a short distance relative to housing 21. Clearance 59 is in fluid communication with bore 12 through upper ports 58 and lower ports 60.

The third component is a plurality of fingers 41 (preferably three, but only one shown) which are disposed equidistantly about shaft 31. An upper end of each finger 41 is pivotally attached to an underside of flared portion 35 with a pin 43. A hinge spring 45 biases each finger 41 to a closed position wherein fingers 41 are flush with an outer surface of housing 21. The inner sides of fingers 41 slidingly engage nose 23 when fingers 41 are not in a retracted position. In the preferred embodiment, shaft 31 also has a pin 47 for a J-slot running tool, a pin 48 for single shot orientation, and a slot 49 for a locking pin 51 for preventing rotational movement of shaft 31.

Figure 4:
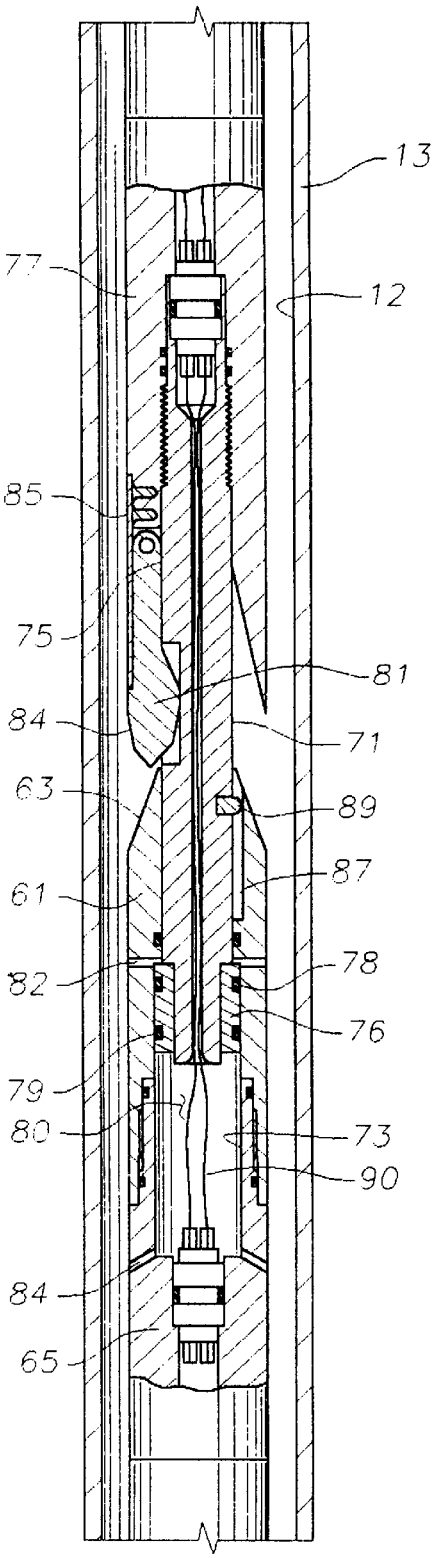
FIG. 4 is a partial sectional side view of a lower centralizer with retracted fingers and is constructed in accordance with the invention.

Referring to FIG. 4, lower centralizer 17 also comprises three major components. The first is an upper housing 61, a tapered nose 63 and a lower housing 65 for attachment to tool 11. Nose 63 is tapered in the range of fifteen to thirty degrees, preferably twenty degrees, relative to the axis of bore 12.

The second major component is shaft 71, which is slidably disposed in an axial bore 73 formed by upper and lower housings 61, 65. Shaft 71 includes a recess 75 and a carrier 77 for attachment to lower housing 21*b*. Shaft 71, carrier 77 and housing 21*b* are axially fastened to one another to eliminate relative movement therebetween. A piston 76 is secured to the lower end of shaft 71. Piston 76 slidingly engages bore 73 with upper and lower O-rings 78, 79. Lower O-ring 79 is cut so that it does not seal against bore 73. A chamber 80 in upper housing 61 extends below piston 76 to allow shaft 71 to move axially a short distance relative to upper housing 61. Chamber 80 is in fluid communication with bore 12 through upper ports 82 and lower ports 84. A set of wires 90 extend through chamber 80 to tool 11. This piston/chamber configuration may also be used in place of the piston/clearance configuration described for upper centralizer 15.

The third component is a plurality of fingers 81 (preferably three, but only one shown) which are disposed equidistantly about shaft 71. An upper end of each of the fingers 81 is pivotally attached in recess 75 with pin 83. The inner sides of fingers 81 slidingly engage nose 63 when fingers 81 are not in a retracted position. A leaf spring 85 biases each finger 81 to a closed position wherein fingers 81 are flush with an outer surface of upper housing 61 and carrier 77. Shaft 71 can reciprocate a short distance in bore 73. In the preferred embodiment, upper housing 61 also has a slot 87 for receiving a locking pin 89 which prevents the rotation of shaft 71.

In FIGS. 2 and 4, centralizers 15, 17 are suspended in drill pipe 13 by a line (not shown), creating an upward force A (FIG. 2) which acts directly on shafts 31, 71. The weight of tool 11, or force B, operates in the opposite direction on housings 61, 65 (FIG. 4). The effect of opposite forces A and B fully extends shafts 31, 71 from housings 21, 61, respectively. With shafts 31, 71 extended, fingers 41, 81, respectively, retract under their own weight and the forces exerted by springs 45, 85, respectively. In the retracted positions, centralizers 15, 17 have the same outer diameter as tool 11 which allows it to easily pass through drill pipe 13.

Figure 3:
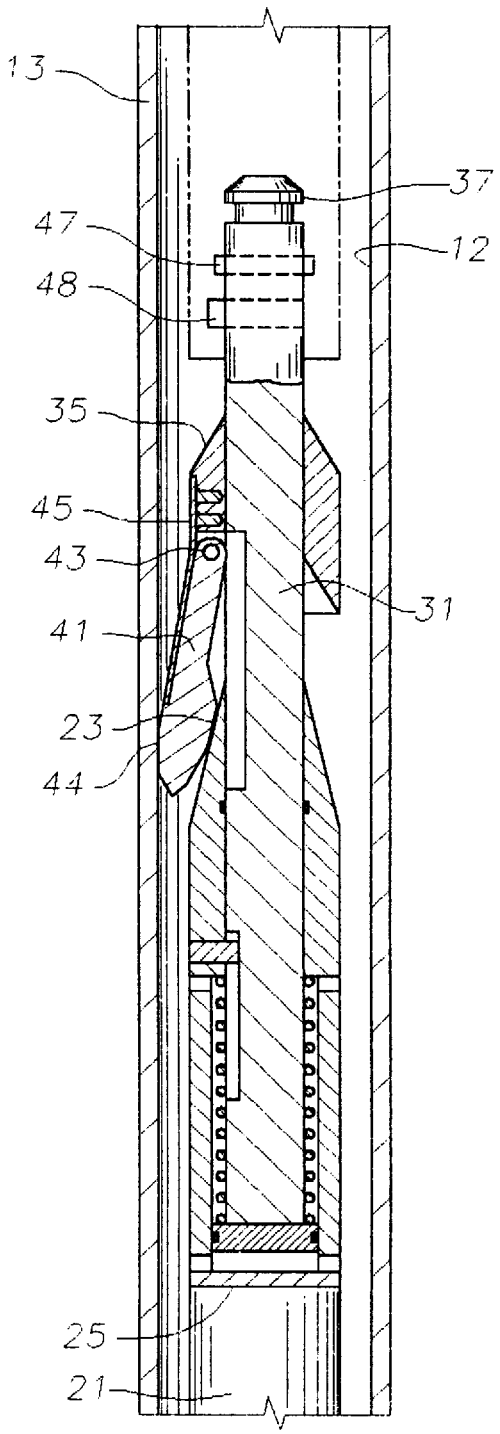
FIG. 3 is a partial sectional side view of the centralizer of FIG. 2 with extended fingers.
Figure 5:
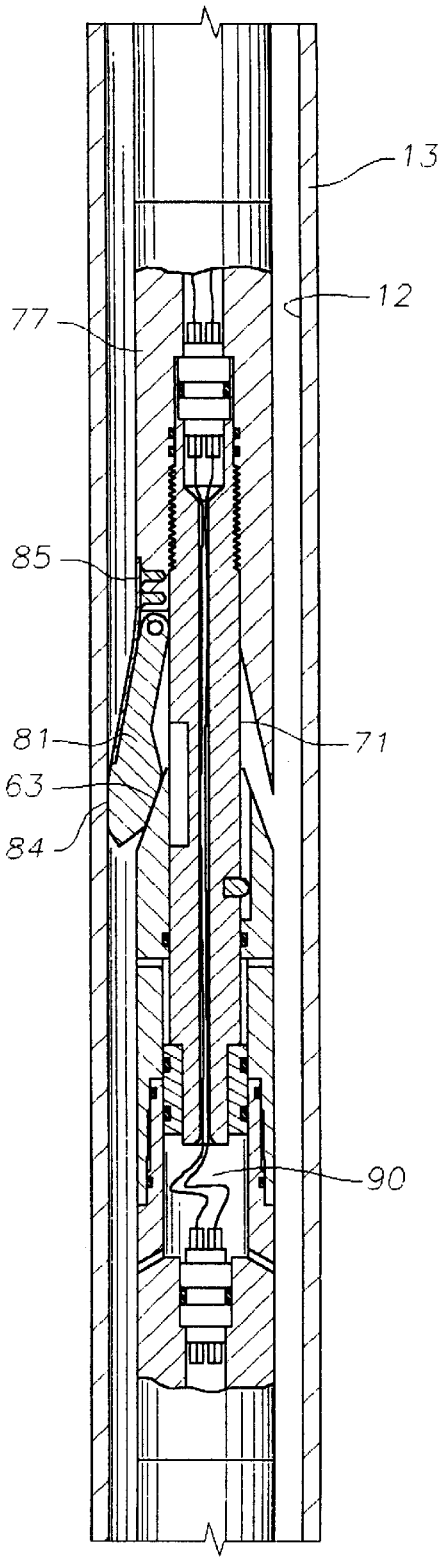
FIG. 5 is a partial sectional side view of the centralizer of FIG. 4 with extended fingers.

FIGS. 3 and 5 depict centralizers 15, 17 in the extended mode, as they would appear during drilling operations (FIG. 1). Prior to drilling, tool 11 may be lowered by wireline until it lands in sub 16. When tool 11 lands in sub 16, force B (FIG. 4) is relieved from shaft 71. In the absence of force B, shaft 71 slides downward into housings 61, 65. This causes fingers 81 to override nose 63 and move outward into flat abutment with bore 12 of drill pipe 13. Because of the twenty degree taper of nose 63, fingers 81 make solid, firm contact with bore 12 but do not frictionally wedge against it. Once the downward movement of shaft 71 ceases, housing 23 also stops moving. Shaft 31 slides downward into housing 21, causing fingers 41 to override nose 43 and move outward into flat abutment with bore 12 of drill pipe 13. The ten degree taper of nose 23 causes fingers 41 to frictionally wedge between nose 23 and bore 12. The taper of nose 43 is sufficient to prevent slippage by a straight upward pull. The tension in the line (force A) relaxes which allows a J-slot in the running tool (not shown) to disengage pin 47 and be retrieved.

During drilling operations when drilling fluid or mud is flowing downward through drill pipe 13, flared portion 35 accelerates the mud flow, thereby causing a hydraulic force to act downwardly on shafts 31, 71 and wedge fingers 41 even more forcibly against bore 12. The combination of the hydraulic force and the weight of shafts 31, 71 causes fingers 41, 81 to exert a continuous outward-directed force against bore 12, thereby assuring rigid automatically self-adjusting centralization of tool 11.

Tool 11 may be retrieved by running the line back down to upper centralizer 15 so that the overshot catches neck 37. Tension is applied to the line (force A). Fingers 41 are jarred loose from bore 12 with jars. Once fingers 41 disengage bore 12, shaft 31 slides upward out of housing 21 to allow fingers 41 to return to the retracted position (FIG. 2). When fingers 41 are fully retracted, shaft 71 begins to move upward out of housings 61, 65. Fingers 81 then effortlessly disengage bore 12 before returning to the retracted position. Tool 11 is lifted from sub 16 when shaft 71 is fully extended.

The invention has several advantages. The combination of a lower centralizer with an upper centralizer maintains the MWD tool in a centralized position more effectively than prior art devices. The fingers of the lower centralizer make solid contact with the bore of the drill pipe but do not wedge against it. This feature also allows the lower centralizer to be easily removed since it does not have to be jarred loose like the upper centralizer.

While the invention has been shown in only some of its forms, it should be apparent to those skilled in the art that it is not so limited, but is susceptible to various changes without departing from the scope of the invention. For example, the tool could have more than two centralizers. Also, the tool could be installed in the drill pipe at the surface so that it would not have to be run in on wireline. The tool could also be retrieved with the drill pipe when tripping out. The centralizers also work with other tools than MWD.

I claim:

1. An apparatus which is lowered into and retrieved from a conduit, comprising:

an upper centralizer having gripping fingers and an upper actuator for moving the fingers from a retracted position to an engaged position in wedging engagement with the conduit, the upper actuator being operable automatically in response to gravity when the apparatus lands on a shoulder in the conduit; and a lower centralizer carried below the upper centralizer, the lower centralizer having gripping fingers and a lower actuator for moving the fingers of the lower centralizer from a retracted position to an engaged position in touching contact with the conduit, the lower actuator being operable automatically in response to the apparatus landing on the shoulder in the conduit; and wherein the lower actuator moves one end of the fingers of the lower centralizer radially outward in the range of fifteen to thirty degrees, relative to a longitudinal axis of the apparatus when moving to the engaged position.

2. The centralizing device of claim 1 wherein the lower centralizer moves to the engagement position before the upper centralizer when the apparatus is landed, and wherein the lower centralizer returns to the retracted position after the upper centralizer when the apparatus is retrieved.

3. A centralizing device for use in combination with a tool which is lowered into and retrieved from a conduit, comprising:

an upper shaft having an axis;

an upper housing coaxial with and slidingly receiving a lower portion of the upper shaft, the upper housing having a tapered nose with a selected taper angle;

a plurality of upper fingers, each having an upper end pivotally mounted to the upper shaft, and a lower end for slidably overriding the upper nose;

a lower shaft carried by the upper housing for movement therewith;

a lower housing coaxial with and slidingly receiving a lower portion of the lower shaft, the lower housing having a tapered lower nose with a selected taper angle that is greater than the selected taper angle of the upper nose; and a plurality of lower fingers, each having an upper end pivotally mounted to the lower shaft, and a lower end for slidably overriding the lower nose; and wherein the selected taper angle of the lower nose is substantially twice as much as the selected taper angle of the upper nose.

4. The centralizing device of claim 3, further comprising a passage through the lower shaft for receiving wires for communication with a tool.

5. The centralizing device of claim 3, further comprising a spring located between each of the fingers and their respective shaft for biasing each of the fingers to the retracted position wherein each of the fingers is flush with an outer surface of their respective housing.

6. A centralizing device for use in combination with a tool which is lowered into and retrieved from a conduit, comprising:

an upper shaft having an axis;

an upper housing coaxial with and slidingly receiving a lower portion of the upper shaft, the upper housing having a tapered upper nose with a selected taper angle;

a plurality of upper fingers, each having an upper end pivotally mounted to the upper shaft, and a lower end for slidably overriding the upper nose;

a lower shaft carried by the upper housing for movement therewith;

a lower housing coaxial with and slidingly receiving a lower portion of the lower shaft, the lower housing having a tapered lower nose with a selected taper angle that is greater than the selected taper angle of the upper nose; and a plurality of lower fingers, each having an upper end pivotally mounted to the lower shaft, and a lower end for slidably overriding the lower nose; and wherein the selected taper angle of the lower nose is in the range from fifteen to thirty degrees and wherein the selected taper angle of the upper nose is in the range from eight to twelve degree, relative to a longitudinal axis of the centralizing device.

7. A centralizing device for use in combination with a tool which is lowered into and retrieved from a conduit, comprising:

an upper shaft having an axis;

an upper housing coaxial with and slidingly receiving a lower portion of the upper shaft, the upper housing having a tapered upper nose with a selected taper angle;

a plurality of upper fingers, each having an upper end pivotally mounted to the upper shaft, and a lower end for slidably overriding the upper nose;

a lower shaft carried by the upper housing for movement therewith;

a lower housing coaxial with and slidingly receiving a lower portion of the lower shaft, the lower housing having a tapered lower nose with a selected taper angle that is greater than the selected taper angle of the upper nose; and a plurality of lower fingers, each having an upper end pivotally mounted to the lower shaft, and a lower end for slidably overriding the lower nose; and wherein the lower shaft has a threaded carrier which has an upper end for attachment to the upper housing, the lower fingers being pivotally mounted to the threaded carrier.

8. A centralizing device for use in combination with a tool which is lowered into and retrieved from a conduit, comprising:

an upper shaft having an axis;

an upper housing coaxial with and slidingly receiving a lower portion of the upper shaft, the upper housing having a tapered upper nose with a selected taper angle;

a plurality of upper fingers, each having an upper end pivotally mounted to the upper shaft, and a lower end for slidably overriding the upper nose;

a lower shaft carried by the upper housing for movement therewith;

a lower housing coaxial with and slidingly receiving a lower portion of the lower shaft, the lower housing having a tapered lower nose with a selected taper angle that is greater than the selected taper angle of the upper nose; and a plurality of lower fingers, each having an upper end pivotally mounted to the lower shaft, and a lower end for slidably overriding the lower nose; and wherein the selected taper angle of the lower nose is at least twenty degrees relative to a longitudinal axis of the centralizing device for preventing the lower fingers from frictionally wedging against the conduit.

9. A method for centralizing a tool in a conduit, comprising:

providing a centralizing device having an upper centralizer and a lower centralizer, each of the centralizers having a tapered nose with a selected taper angle, and gripping fingers which move between a retracted position and an engaged position while slidably overriding their respective noses;

connecting the upper and lower centralizers to a tool;

lowering the tool into the conduit on a line while the fingers are in the retracted position; and landing the tool on a shoulder in the conduit, thereby causing the fingers to move to the engaged position, the fingers of the upper centralizer wedging against the conduit for resisting upward acting forces after the fingers of the lower centralizer contact the conduit without wedging against the conduit; and wherein the step of landing the centralizing device comprises pivoting one end of the fingers of the lower centralizer radially outward in the range of fifteen to thirty degrees, relative to the conduit.

10. The method of claim 9 wherein the step of landing the centralizing device comprises pivoting one end of the fingers of the upper centralizer radially outward in the range of eight to twelve degrees, relative to the conduit.

11. The method of claim 9, further comprising retrieving the tool, comprising:

running a wireline through the conduit and attaching it to an upper end of the tool;

pulling upward on the wireline to jar the fingers of the upper centralizer loose from the engaged position so that they return to the retracted position; and lifting the tool out of the conduit so that the fingers of the lower centralizer fall from the engaged position into the retracted position.

* * * * *

UNITED STATES PATENT AND TRADEMARK OFFICE

CERTIFICATE OF CORRECTION

PATENT NO. : 5,934,378
DATED : August 10, 1999
INVENTOR(S) : *Tchakarov*

It is certified that error appears in the above-identified patent and that said Letters Patent is hereby corrected as shown below:

In col. 1 line 20, delete "MW)" and insert instead --MWD--.

In col. 5 (Claim 3), line 25, please insert --upper-- between "tapered" and "nose".

In col. 6 (Claim 6), line 7, please delete "degree" and insert instead --degrees--.

Signed and Sealed this
First Day of February, 2000

*Attest:*

*Attesting Officer*

Q. TODD DICKINSON

*Acting Commissioner of Patents and Trademarks*